US006550385B1

(12) United States Patent
Colin et al.

(10) Patent No.: US 6,550,385 B1
(45) Date of Patent: Apr. 22, 2003

(54) CAM-INDEPENDENT DRIVE FOR FOLDING COMPONENTS

(75) Inventors: Alain Colin, Lamorlame (FR); Louis Deviras, Villers St. Paul (FR); Sherif Elkotbi, Compiegne (FR); Gerard Guerinet, Liancourt (FR); Jean-Claude Marmin, Estrees-Saint-Denis (FR); Jean-Paul Ramond, Ronquerolles (FR); Thierry Vauchelle, Ravenel (FR)

(73) Assignee: Heidelberger Druckmaschine AG, Heidelberg (DE)

( * ) Notice: Subject to any disclaimer, the term of this patent is extended or adjusted under 35 U.S.C. 154(b) by 362 days.

(21) Appl. No.: 09/614,663

(22) Filed: Jul. 12, 2000

(30) Foreign Application Priority Data

Jul. 12, 1999 (DE) ..... 199 32 471
Mar. 31, 2000 (FR) ..... 0004119

(51) Int. Cl.[7] ..... B41F 13/54; B41F 13/56; B41F 5/00; B41F 13/24

(52) U.S. Cl. ..... 101/228; 101/216; 101/226; 101/227; 101/232; 101/248; 270/92

(58) Field of Search ..... 101/248, 216, 101/226, 232, 227, 228; 270/92

(56) References Cited

U.S. PATENT DOCUMENTS 2,435,881 A 2/1948 Faeber
2,486,703 A 11/1949 Bishop
5,000,433 A 3/1991 Prüm et al.
5,439,029 A * 8/1995 Becker ..... 137/580
5,720,224 A * 2/1998 Mueller ..... 101/248
5,772,571 A 6/1998 Marcle-Geller et al.
5,901,647 A * 5/1999 Kohlmann ..... 101/216
5,937,761 A * 8/1999 Buschmann et al. ..... 101/424.1
6,073,970 A * 6/2000 Ott et al. ..... 285/13

FOREIGN PATENT DOCUMENTS

DE 195 30 956 A1 5/1996
DE 196 16 629 A1 11/1997

* cited by examiner

*Primary Examiner*—Andrew H. Hirshfeld
*Assistant Examiner*—Marvin P. Crenshaw
(74) *Attorney, Agent, or Firm*—Laurence A. Greenberg; Werner B. Stemer; Gregory L. Mayback

(57) ABSTRACT

In a folder, a folding cylinder having folding components accommodated on the periphery thereof and being phase-dependently operatable, and cylinder segments for carrying the folding components, the cylinder segments being adjustable in relation to one another and being mounted coaxially in side walls, includes separate drives, respectively, for driving each of the folding components, a rotary leadthrough via which energy is supplied to the separate drives, and a speed controller for speed-dependently controlling the separate drives; a method of operating the folding cylinder; a folder including the folding cylinder; and a rotary printing machine in combination with the folder including the folding cylinder.

13 Claims, 2 Drawing Sheets

CAM-INDEPENDENT DRIVE FOR FOLDING COMPONENTS

BACKGROUND OF THE INVENTION

Field of the Invention

The invention relates to a cam-independent drive for folding components, such as folding blades or movable folding jaws, on folders disposed downline from rotary printing machines.

The published patent document WO 98/06581 discloses a cylinder drive for cylinders of rotary printing machines. The drive motor of the cylinder is flange-mounted on an eccentric bushing accommodating the cylinder bearing and, when the eccentric bushing is suitably adjusted by an actuating cylinder, is also moved synchronously with the cylinder. The drive motor and the cylinder journal are connected to one another via an interposed coupling.

In the published German Patent Documents DE 195 30 956 A1 and DE 196 16 629 A1, devices for changing over a product-guiding cylinder in a folder are described. These German patent documents disclose a device for changing over a product-guiding cylinder of a folder from collecting to non-collecting production and the reverse. The collecting cylinder is equipped, on the circumference thereof, with at east one folding blade and at least one set of holding elements. Also provided are both a folding-blade control cam, having a circumferential contour forming a control cam for actuating elements which generate the movement of the folding blades, and a holding-element control cam having a circumferential contour forming a control cam for the actuating elements which generate the movement of the holding elements. A device for the drive-independent movement of one of the control cams in order to change over or convert between collecting and non-collecting production is also provided, as well as automatically activated actuating elements for the radial movement of the actuating elements of the folding blades and of the holding elements, which move the actuating elements both axially and radially. The mechanical outlay or expense shown in the two last-mentioned publications for driving the folding elements is very high, and the ability to displace the control cams actuating the latter is very great.

In folders disposed downline from rotary printing machines, the cylinders carrying folded products are provided with folding components, such as folding blades, folding jaws, pins or holding devices for gripping the copies. These folding components are generally driven by control rollers which run on cam sections defining the actuating time of the control roller of the corresponding folding component. The surfaces of the control cam are produced in special production steps, are ground and machined with an extremely high surface quality. In order to increase the service life, the surfaces on which the control cams run are subjected to single-stage or multi-stage hardening processes. The control cams for the folding components therefore constitute components, in a folder, which are very complicated to produce and are, therefore, extremely costly.

In conventional cam/control roller arrangements for driving folding components in a folder at high speeds, lifting the control roller off the running surfaces of the cams occurs, caused by the action of centrifugal force. Consequently, the control rollers have high bias forces applied to them in order to suppress any lifting of the rollers off the running surfaces of the cams. Undesired associated phenomena of the bias forces applied to the control rollers are the high forces to which the components are therefore forcibly subjected, which can lead to insidiously occurring premature material fatigue.

SUMMARY OF THE INVENTION

In view of the indicated technical problem, it is an object of the invention to provide a cam-independent drive for folding components that serves as a cost-effective replacement for cam control, and achieves a low maintenance requirement.

With the foregoing and other objects in view, there is provided, in accordance with one aspect of the invention, in a folder, a folding cylinder having folding components accommodated on the periphery thereof and being phase-dependently operatable, and cylinder segments for carrying the folding components, the cylinder segments being adjustable in relation to one another and being mounted coaxially in side walls, comprising separate drives, respectively, for driving each of the folding components, a rotary leadthrough via which energy is supplied to the separate drives, and a speed controller for speed-dependently controlling the separate drives.

In accordance with another feature of the invention, a respective speed controller is assigned to each of the separate drives.

In accordance with a further aspect of the invention, in the folder, the speed controller is common to all of the separate drives and is disposed outside the folding cylinder.

In accordance an added feature of the invention, the folding cylinder includes a rotary encoder for transmitting the position of the respective folding components to the speed controller.

In accordance with an additional feature of the invention, the rotary encoder has a resolving power of 213 scale divisions.

In accordance with yet another feature of the invention, the folding cylinder includes a transmitter/receiver pair via which a reference position is transmittable between a stationary component and a rotating component.

In accordance with yet a further feature of the invention, the folder includes a cutting cylinder, and a reference position of the folder is determinable by sensing the rotary position of the cutting cylinder.

In accordance with an added aspect of the invention, there is provided an assembly of the folder and a rotary printing machine disposed upline therefrom, wherein the rotary printing machine includes a transfer roller, and wherein a reference position of the rotary printing machine is determinable by sensing the rotary position of the transfer cylinder.

In accordance with another feature of the invention, the folding cylinder includes an optical wave guide via which the reference position is transmittable to the speed controller.

In accordance with a further feature of the invention, the folding cylinder includes mechanical transmission elements provided between the drive and the respective folding components.

In accordance with an added feature of the invention, the folding components are mounted on shafts formed at least partly of titanium.

In accordance with yet another aspect of the invention, there is provided a method for operating, independently of control cams, folding components accommodated on the circumference of a folding cylinder, which comprises: determining a reference position of at least one of a folder and a rotary printing machine; positioning the folding components with respect to the determined reference position; and transmitting to a speed controller an offset between the reference position and actual positions of the folding components.

In accordance with still another mode, the method of the invention includes determining the reference position by determining the rotary position of a cutting cylinder in the folder.

In accordance with still a further mode, the method includes determining the reference position by determining the rotary position of a transfer cylinder in the rotary printing machine.

In accordance with another aspect of the invention, there is provided a folder for a rotary printing machine, having a folding cylinder equipped, on the periphery thereof, with phase-dependently operatable folding components, the folding components being movable relative to one another in accordance with a format and a folding mode and being accommodated coaxially in side walls, comprising a separate drive for driving the folding components, a rotary leadthrough via which energy is supplied to said separate drive, and a speed controller via which the separate drive is speed-dependently drivable.

In accordance with a concomitant aspect of the invention, there is provided a rotary printing machine in combination with a folder which is equipped with at least one folding cylinder having, on the periphery thereof, phase-dependently actuatable folding components which are format-dependently and folding mode-dependently movable relative to one another and are accommodated coaxially in side walls, comprising a separate drive for driving the folding components, a rotary leadthrough via which energy is supplied to the separate drive, and a speed controller for speed-dependently driving the separate drive.

The advantages associated with the method modes and the features according to the invention are many and various. The control cams, which are provided at the ends of the cylinders carrying the folded copies, for the control rollers operating the folding components can be dispensed with, as can also the complicated assembly work, such as torque presetting and so forth associated with this type of control when assembling the cylinders. Consequently, more cost-effective assembly and maintenance of the folding cylinders can be achieved; components which are complicated and expensive to produce, such as control cams with surfaces which have to be machined very accurately, and the biasing devices necessary at high production speeds for the control rollers running on the cam running surface, can be dispensed with.

In a further development of the basic idea of the invention, each of the drives for the folding components can have a separate speed controller assigned thereto and, equally well, a speed controller that is common to all the separate drives can be provided outside the folding cylinder. In the context of this application, the generic term folding cylinder is meant to include a folding-blade cylinder, a folding-jaw cylinder, a separate pin cylinder, a collecting cylinder and a gripper cylinder as well as a transport cylinder.

In order to feed back and detect the actual position of the folding components, the latter can advantageously have rotary encoders assigned thereto, which can have a very high resolving power, for example up to $2^{13}$ scale divisions. The rotary encoders can be assigned directly to the folding components, in order to detect their present and actual position.

The reference position of the folder or of the rotary printing machine preceding or disposed upline from the latter is preferably determined and transmitted between a stationary component and a rotating component, via a transmitter/receiver pair. An example of such a rotating component may be, for the folder, the cutting cylinder separating the copies from the material web and, for the rotary printing machine, the transfer cylinder of one of the printing units.

If the speed controllers for the drives of the folding components are accommodated, for example, on the shafts of the folding components themselves, the reference position can be transmitted to the speed controller via optical waveguides over fiber optic or similar devices. By the transmitter/receiver parts, the reference position may thus be transmitted to a large number of speed controllers assigned individually to folding components. The folding components, such as folding blades, the moving part of the folding jaws, pins and grippers on the cylinder, can either be moved in an oscillatory manner directly by drives accommodated on the actuating shafts or, on the other hand, transmission elements such as belts, gearwheels or the like can be provided between the shafts accommodating the folding components and the drives. In order to achieve the lowest possible moment of inertia and, at the same time, ensure adequate mechanical strength, the shafts accommodating the folding components can be produced from titanium or titanium alloys.

By the method according to the invention, in order to achieve the cam-independent operation of the folding components accommodated on the circumference of a folding cylinder, initially, the reference position of the folder and/or of the rotary printing machine preceding or located upline of the latter is determined. Then, the then current, actual positions of the folding components are determined, and the offsets between the reference position and the then current position is transmitted to the drives. The reference position used for determining the reference position of the folder or the rotary printing machine can, on the one hand, be the position of the cutting cylinder of the folder or, on the other hand, the position of the transfer cylinder of a printing unit of the rotary printing machine.

Folding cylinders according to the invention and the method proposed by the invention for operating folding components can advantageously be employed on folders with and without a collecting mode, it being possible for the thickness of the copies to be kept variable throughout, depending upon the production requirement in the printing plant or print shop.

Other features which are considered as characteristic for the invention are set forth in the appended claims.

Although the invention is illustrated and described herein as embodied in a cam-independent drive for folding components, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
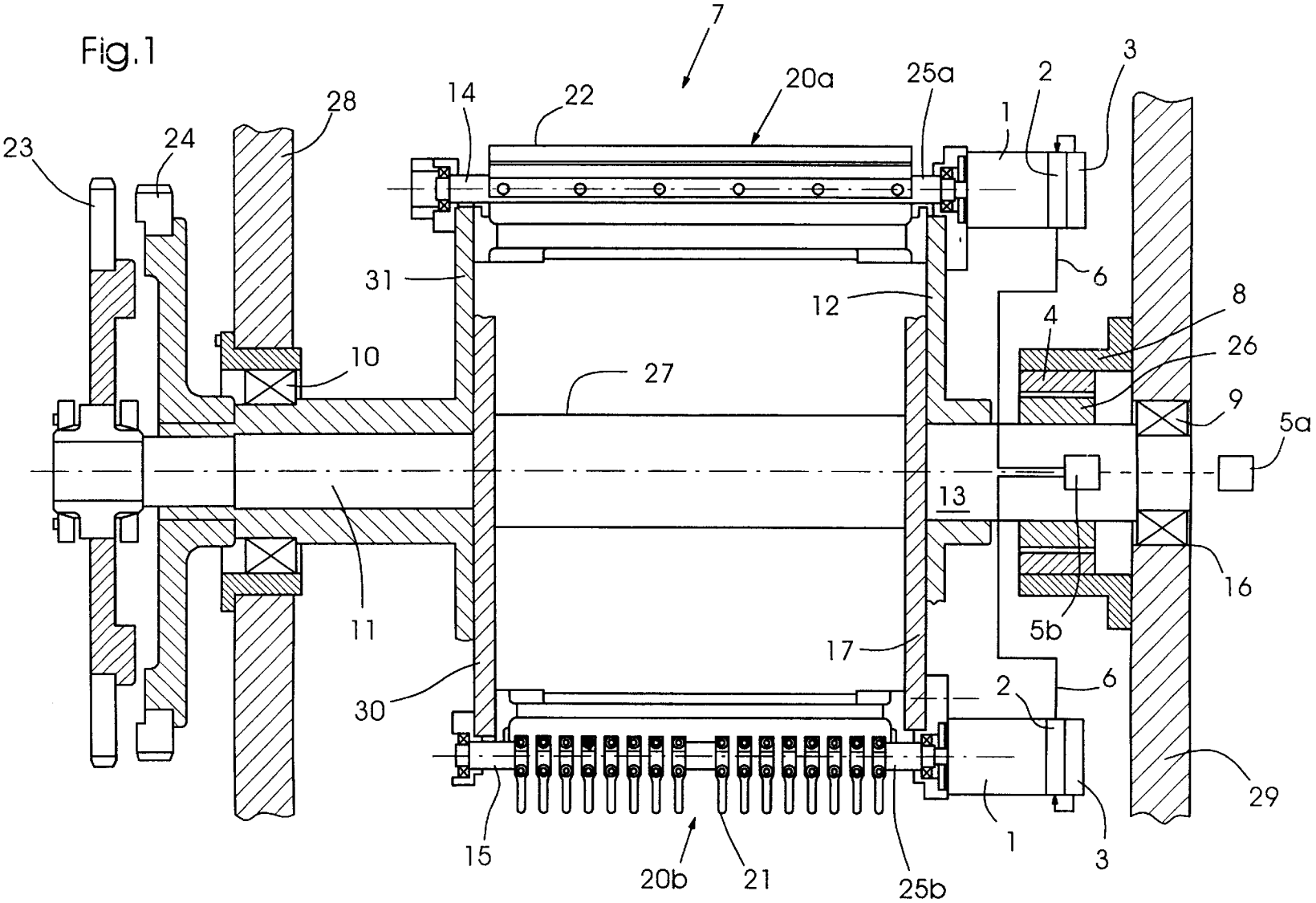
FIG. 1 is a diagrammatic longitudinal sectional view of a copy-carrying folding cylinder accommodating, on the circumference thereof, folding components including folding blades and pins located opposite one another, as seen in the sectional view.

Referring now to the drawings and, first, particularly to FIG. 1 thereof, there is shown therein the diagrammatic construction of a copy-guiding folding cylinder 7, on the circumferential surface of which, whereon copies are guided, for example, folding blades and pins can be accommodated, the folding blades and pins being drivable individually via drives respectively assigned thereto. Accommodated in side walls 28 and 29 of a folder, in respective bearings 9 and 10, is a cylinder shaft 27 of the folding cylinder 7. On the drive side, the folding cylinder 7 has two drive gears 23 and 24, respectively, which are integrated into respective drive-gear trains on the drive side of the folder. A cylinder journal 11 of the cylinder shaft 27 is driven by the drive gear 23 located at the outside. Carried on the cylinder shaft 27 are folding-cylinder segments 17 and 30 which, in the embodiment illustrated in FIG. 1, accommodate folding components 20*b*. The folding components 20*b* may be pins 21, for example.

By the further drive gear 24 on the drive side of the folder, a sleeve-like attachment enclosing the cylinder journal 11 serves to drive segments 12 and 31 of the folding cylinder 7, whereon folding elements 20*a* in the form of a folding blade 22 are mounted. Due to the mounting the folding components 20*a* and 20*b* in segments of the folding cylinder 7, the folding components 20*a* and 20*b* may be adjusted with reference to one another depending upon the folding mode, i.e., cross-folding mode, double-parallel fold or delta-fold; the changeover of the segments 17 and 30, on the one hand, with reference to the segments 12 and 31, on the other hand, is performed with the folder at a standstill, somewhat within the context of a new set-up of a print job.

On the side located opposite the drive side of the folding cylinder 7 having the aforedescribed drive-gear trains 23 and 24, in a bore 16 formed in the side wall 29, a transmitter/receiver pair 5*a*, 5*b* is mounted. The transmitting part 5*a* is located on the outside of the side wall 29, while the receiving part 5*b* is accommodated in the cylinder shaft journal 13. From the latter, there extend optical wave guides 6, which are connected to the speed controllers 2 on the drives 1 for the folding components 20*a* and 20*b*. In the illustrated exemplary embodiment, only the two folding components 20*a* and 20*b* located opposite one another in the section plane are illustrated in the sectional view taken through the folding cylinder 7. In practice, however, up to ten folding components 20*a* and 20*b* are accommodated on the periphery of a folding cylinder 7, depending upon the diameter, and can be provided with separate drives 1, in each case connected via optical wave guides 6 to a receiving part 5*b* in the interior of the cylinder journal 13.

In the illustrated embodiment, the drives 1, respectively, are connected directly to the shafts 14 and 15 of the folding components 20*a* and 20*b*, which execute oscillatory movements about the respective axes of rotation 25*a* and 25*b* thereof. It is equally possible, however, to provide transmission elements, such as toothed belts, belts or gearwheels, toothed chains or the like, between the drives 1 and the folding-blade shaft 14 and, respectively, the pin shaft 15 carrying the pins 21.

The drives 1 are connected electrically, via a rotary leadthrough illustrated only diagrammatically herein, to a winding or coil 26 on the outside of the cylinder journal 13 and a winding or coil 4 accommodated in a distributor housing 8 so as to rotate therewith. On the speed controller 2, each of the drives 1 for the respective folding components 20*a* and 20*b* has a rotary encoder 3 assigned thereto, with which the current or actual rotary position of the respective folding components 20*a* and 20*b* with reference to the axis of rotation 15*a* and 15*b* can be detected and fed back to the speed controller 2. The encoder 3 may very advantageously be a high-resolution rotary encoder having a resolving power in the order of magnitude of 213 scale divisions. Assurance is thereby provided that the precise position of a folding component 20*a*, 20*b* will be fed back to the speed controller 2. Instead of being disposed on each individual drive 1, the speed controller 2 can also be accommodated separately on the housing wall 29 outside the folder, for example, in a switch box or a controller, and control the drives 1 of the folding components 20*a* and 20*b* from there.

If brushless electric motors, for example, are used as the drives 1, the necessary maintenance effort for these drives is reduced considerably, because the motor components are barely hardly subjected to any more wear and for this reason can be installed perfectly well in the interior of a folder. By this brushless construction of the drives 1, the folding components 20*a* and 20*b* may be controlled directly via the transmitter/receiver combination 5*a*, 5*b* and via optical wave guides 6 without mechanical components, and can be driven so as to oscillate about the respective axes of rotation 14 and 15 thereof.

In order to reduce the forces which occur at higher operating speeds, in particular the occurring inertial forces, the folding-blade shaft 14 and the pin shaft 15, respectively, can be produced from titanium or titanium alloys.

Figure 2:
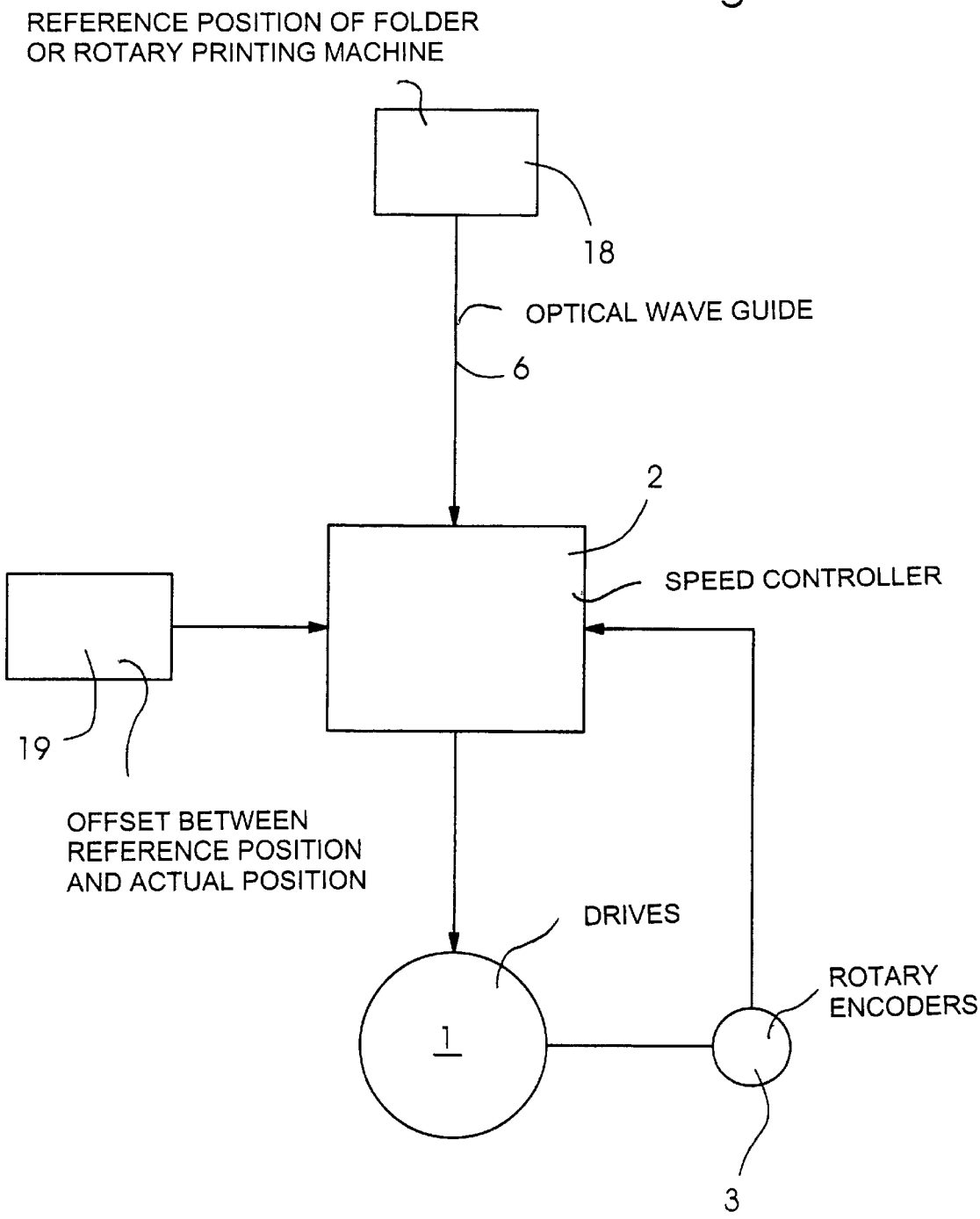
FIG. 2 is a block diagram of a speed control system for the drives of the folding components accommodated on the circumference of the folding cylinder.

FIG. 2 illustrates the principle of the speed control system for the folding components 20*a* and 20*b*.

The reference position 18 of the folder or of the rotary printing machine preceding or disposed upline of the folder is transmitted by an optical wave guide 6 to the speed controller 2 which, in turn, controls the drive 1, implemented in this embodiment as a brushless electric motor, in accordance with the speed at which the rotary printing machine preceding or disposed upline of the folder is operated. The higher the operating speed of the rotary printing machine, the less time is available for the insertion and retraction movements, for example, of the folding blade 22 and the pins 21 on the folding cylinder 7. If the drives 1 are used on movable folding jaws on a folding-jaw cylinder, it is necessary to take into account the fact that, depending upon the number of pages of the copy to be cross-folded, the movable folding-jaw parts have to open farther the more pages there are in the copy to be knocked or pushed into the jaws by the folding blade 22, in order to form a correct folded back on the copy.

At higher operating speeds of the rotary printing machine, a shorter time interval is available for the oscillatory movements of the folding blades 22 about the folding-blade shaft 14, and the pins 21 about the pin shaft 15, and this shorter time interval has to be compensated for via the speed-dependent driving of the brushless drives 1 of the folding components 20*a* and 20*b*. The encoders 3 respectively assigned to the folding components 20*a* and 20*b* permit the actual rotary position of the latter to be detected and fed back to the speed controllers 2. A reference position 18 of the folder can be detected reliably by interrogating the rotary position of the cutting cylinder in the folder while, in order to detect the reference position of the rotary printing machine, a transfer cylinder of a selected printing unit can be designated for this purpose. The offset 19 existing between the reference position 18 of the folder or the rotary printing machine and the actual position of the folding components 20*a* and 20*b* is likewise taken into account in the driving of the speed controller 2, the very instant that the brushless drives 1 driving the folding components 20*a* and 20*b* become driven.

By the method according to the invention, the folding components on the circumference of copy-carrying folding cylinders can be operated as a function of the operating speed of the folder or of the rotary printing machine. If a reference position 18 is obtained from the rotary position of a transfer cylinder of a printing unit in the rotary printing machine, the folder can be controlled synchronously with the rotary printing machine, so that the folder can be operated in synchronism with the preceding or upline rotary printing machine without any time lag in relation to the latter.

We claim:

1. In a folder, a folding cylinder having a first set and a second set of folding components accommodated on the periphery thereof and being phase-dependently operatable, and cylinder segments for carrying the first set and the second set of the folding components, respectively, the cylinder segments being adjustable in relation to one another and being mounted coaxially in side walls, comprising separate drives, respectively, for driving each of the sets of the folding components, a rotary leadthrough via which energy is supplied to said separate drives, and a speed controller for speed-dependently controlling said separate drives.

2. The folding cylinder according to claim 1, wherein a respective speed controller is assigned to each of said separate drives.

3. The folder according to claim 1, wherein said speed controller is common to all of said the separate drives and is disposed outside the folding cylinder.

4. The folding cylinder according to claim 1, including a rotary encoder for transmitting the position of the respective folding components to said speed controller.

5. The folding cylinder according to claim 4, wherein said rotary encoder has a resolving power of $2^{13}$ scale divisions.

6. The folding cylinder according to claim 1, including a transmitter/receiver pair via which a reference position is transmittable between a stationary component and a rotating component.

7. The folding cylinder according to claim 6, including an optical wave guide via which said reference position is transmittable to said speed controller.

8. The folder according to claim 1, including a cutting cylinder, and wherein a reference position of the folder is determinable by sensing the rotary position of said cutting cylinder.

9. An assembly of the folder according to claim 1 and a rotary printing machine disposed upline therefrom, wherein the rotary printing machine includes a transfer cylinders and wherein a reference position of said rotary printing machine is determinable by sensing the rotary position of said transfer cylinder.

10. The folding cylinder according to claim 1, including mechanical transmission elements provided between said drive and the respective folding components.

11. The folding cylinder according to claim 1, wherein the folding components are mounted on shafts formed at least partly of titanium.

12. A folder for a rotary printing machine, having a folding cylinder equipped, on the periphery thereof, with a first set and a second set of phase-dependently operatable folding components, the folding components being movable relative to one another in accordance with a format and a folding mode and being accommodated coaxially in side walls, comprising a separate drive for driving each of the sets of the folding components, a rotary leadthrough via which energy is supplied to said separate drive, and a speed controller via which said separate drive is speed-dependently drivable.

13. A rotary printing machine in combination with a folder which is equipped with at least one folding cylinder having, on the periphery thereof, a first set and a second set of phase-dependently actuatable folding components which are format-dependently and folding mode-dependently movable relative to one another and are accommodated coaxially in side walls, comprising a separate drive for driving each of the sets of the folding components a rotary leadthrough via which energy is supplied to said separate drive, and a speed controller for speed-dependently driving said separate drive.

* * * * *